US009114451B2

(12) United States Patent
Chasteen et al.

(10) Patent No.: US 9,114,451 B2
(45) Date of Patent: Aug. 25, 2015

(54) CONTAINER END CLOSURE WITH BUCKLE CONTROL FEATURE

(71) Applicant: Ball Corporation, Broomfield, CO (US)

(72) Inventors: Howard C. Chasteen, Westminster, CO (US); Mark A. Jacober, Arvada, CO (US)

(73) Assignee: BALL CORPORATION, Broomfield, CO (US)

( * ) Notice: Subject to any disclaimer, the term of this patent is extended or adjusted under 35 U.S.C. 154(b) by 0 days.

(21) Appl. No.: 14/073,492

(22) Filed: Nov. 6, 2013

(65) Prior Publication Data

US 2014/0263327 A1 Sep. 18, 2014

Related U.S. Application Data

(60) Provisional application No. 61/798,301, filed on Mar. 15, 2013.

(51) Int. Cl.

| | |
|---|---|
| ***B65D 17/34*** | (2006.01) |
| ***B21D 51/44*** | (2006.01) |
| ***B65D 17/00*** | (2006.01) |

(52) U.S. Cl.

CPC ..... *B21D 51/44* (2013.01); *B65D 17/165* (2013.01); *B65D 2517/0014* (2013.01); *B65D 2517/0068* (2013.01); *B65D 2517/0074* (2013.01); *B65D 2517/0089* (2013.01); *Y10T 29/49863* (2015.01)

(58) Field of Classification Search

CPC ..... B65D 17/165; B65D 2517/0014; B65D 2517/0074; B65D 2517/0089; B65D 2517/0068; B21D 51/44; Y10T 29/49863

USPC ..... 220/269, 906, 619; 413/8, 12, 14–16

See application file for complete search history.

(56) References Cited

U.S. PATENT DOCUMENTS

| | | | |
|---|---|---|---|
| 4,132,328 | A | 1/1979 | Zundel |
| 4,394,927 | A | 7/1983 | Zysset |
| 4,503,989 | A | 3/1985 | Brown et al. |
| 4,535,909 | A | 8/1985 | Zysset |
| 4,577,774 | A | 3/1986 | Nguyen |
| 4,796,772 | A | 1/1989 | Nguyen |
| 4,928,844 | A | 5/1990 | LaBarge |
| 5,590,807 | A | 1/1997 | Forrest et al. |

(Continued)

FOREIGN PATENT DOCUMENTS

| | | |
|---|---|---|
| JP | S63-303639 | 12/1988 |
| JP | H06-179443 | 6/1994 |

(Continued)

OTHER PUBLICATIONS

International Search Report and Written Opinion for International Patent Application No. PCT/US2014/018866, mailed Jun. 16, 2014, 9 pages.

*Primary Examiner* — Fenn Mathew
*Assistant Examiner* — James N Smalley
(74) *Attorney, Agent, or Firm* — Sheridan Ross P.C.

(57) ABSTRACT

An end closure for food and beverage containers is provided. The end closure comprises a central panel portion having an induced buckle coin and an interrupted panel coin positioned proximate to an inner panel wall to control the buckling location on the end closure. Thus, the end closure will buckle at a predetermined location away from the score and tear panel to avoid catastrophic failure and container leakage.

18 Claims, 11 Drawing Sheets

(56) References Cited

U.S. PATENT DOCUMENTS

| | | | |
|---|---|---|---|
| 5,598,734 | A | 2/1997 | Forrest et al. |
| 5,829,623 | A | 11/1998 | Otsuka et al. |
| 6,077,554 | A | 6/2000 | Wiemann et al. |
| 6,089,072 | A | 7/2000 | Fields |
| 6,908,005 | B1 | 6/2005 | Strube et al. |
| 7,107,928 | B2 | 9/2006 | Chasteen et al. |
| 7,370,774 | B2 | 5/2008 | Watson et al. |
| 7,591,392 | B2 | 9/2009 | Watson et al. |
| 7,926,675 | B2 | 4/2011 | Rieck et al. |
| 8,157,119 | B2 | 4/2012 | Watson et al. |
| 8,328,492 | B2 | 12/2012 | Turner et al. |
| 8,496,132 | B2 | 7/2013 | Watson et al. |
| 8,851,323 | B2 | 10/2014 | Watson et al. |
| 2011/0297679 | A1 | 12/2011 | Gogola et al. |
| 2013/0306658 | A1 | 11/2013 | Watson et al. |

FOREIGN PATENT DOCUMENTS

| | | |
|---|---|---|
| JP | 2000159229 | 6/2000 |
| JP | 2002145263 | 5/2002 |
| JP | 2002239662 | 8/2002 |
| JP | 4666327 | 4/2011 |
| WO | WO 03/039785 | 5/2003 |
| WO | WO 2012/143322 | 10/2012 |

QUADRANT ZONES

CONTAINER END CLOSURE WITH BUCKLE CONTROL FEATURE

RELATED APPLICATIONS

This application claims the benefit of U.S. Provisional Patent Application Ser. No. 61/798,301, filed Mar. 15, 2013, entitled "Container End Closure with Buckle Control Feature," which is hereby incorporated by reference in its entirety.

FIELD OF THE INVENTION

Embodiments of the present invention generally relate to containers and container end closures, and more specifically metallic beverage container end closures with buckle control features.

BACKGROUND OF THE INVENTION

Containers, and more specifically metallic beverage containers, generally contain a neck on an upper portion that is adapted for interconnection to a metallic end closure. The container end closure is formed from a flat sheet of metallic material and generally includes a pull tab or other form of stay on tab ("SOT"). Beverage containers commonly store carbonated beverages, thus, both the container body and the container end closure are required to withhold internal pressures up to 90 psi while under varying temperatures without catastrophic failure or permanent deformation. Further, the container end closure must be manufactured, stacked, shipped, and sent to a filler prior to being seamed onto a container body filled with a carbonated beverage. Thus, the container and end closure must be designed to resist deformation and failure while utilizing thin metallic materials and allowing compact stacking during shipping and manufacturing.

Food and beverage containers with pull tabs or SOTs are generally known. Various SOTs and related features are disclosed, by way of example, in U.S. Pat. No. 7,926,675 to Rieck et al., the entire disclosure of which is hereby incorporated by reference in its entirety. Known end closures, however, generally may buckle when under varying temperatures and internal pressure. If an end closure buckles near the score lines, tear panel, or pour opening, the score line may fail and release the pressurized contents of the container. Many users of conventional devices, such as SOTs for pressurized containers, may have experienced "peak and leak" when they have left pressurized containers in their cars under hot conditions. As the heat of the car increases, so does the internal temperature and internal pressure of the container. The increased internal pressure causes the end closure to buckle and crack the score, thus spilling the contents of the container. Peak and leak is when the end closure buckles and causes the score line to fracture such that the contents of the container leak out. Peak and leak may result in not only the failure of a specific can, but the spoilage of other containers once they become covered with carbonated soda or beer. Accordingly, there exists a significant need for a beverage container end closure that will not buckle near the score line or tear panel such that the score line cracks causing catastrophic failure.

Previous attempts have been made to manufacture container end closures that resist buckling near the opening, or control where the buckling occurs. Prior art methods of reducing burst-before-buckle used a coined bead at the 6 o'clock position to reduce flexure or modified the deboss wall in front of the 6 o'clock score position to eliminate deboss buckle. Note that "induced buckle coin" may be used interchangeably herein with "buckle coin."

For purposes of further disclosure, the following references generally related to end panels with buckle control features and are hereby incorporated by reference in their entireties:

Japanese Patent Publication No. JP2002145263 to Yoshihiko;
Japanese Patent Publication No. JP2000159229 to Yoshihiko;
U.S. Pat. No. 5,829,623 issued to Otsuka et al. on Nov. 3, 1998; and
U.S. Pat. No. 8,157,119 issued to Watson et al. on Apr. 17, 2012.

Due to the numerous limitations associated with the prior art described above, the following disclosure describes an improved container end closure that is adapted for interconnection to a container body and that employs buckle control features. This novel feature provides control of the buckle location, significantly improves the end closure's buckle resistance near the opening and score line, and reduces the likelihood of catastrophic failure along with the release of carbonated beverages.

SUMMARY OF THE INVENTION

These and other needs are addressed by the various embodiments and configurations of the present invention. This disclosure relates to a novel system, device, and method for providing a food and beverage container end closure with controlled buckle located away from the tear panel and score line. The novel end closure provided herein buckles on the central panel portion in a predetermined location opposite the tear panel so that buckling does not occur near the score line or opening, and cause premature opening or "peak and leak."

During pressurization of a standard end closure, one can visually see the flexing of the panel and score at the 6 o'clock position regardless of the manufacturing process. The 6 o'clock position of the end closure is between the score line and the countersink at a point along the end closure's vertical center line opposite the tab lift tail or pull ring, and positioned proximate to the pour opening. Thus, if an analog clock face was placed on the end closure, the 6 o'clock position of the end closure would be where the number six is located on the clock face. The close proximity of the deboss and score to the peripheral edge of the central panel creates the weakest area on the panel face. When an end closure with a large, wide score profile is under pressurization, the score path bows at the 6 o'clock position and can subsequently fracture the score and cause failure and leakage. By using an induced buckle coin in an upper quadrant of the end closure (i.e., a quadrant without a score line), the upper quadrant becomes the weakest area on the panel face, thus shifting the bowing away from the 6 o'clock score position, allowing buckling in a predetermined location opposite the score, and preventing catastrophic failure.

Features of the present disclosure may be employed in a wide range of food and beverage containers, including pressurized beverage containers with SOTs secured by a rivet, food containers with tear away lids, and full-panel easy-open end tabs, to name a few. Although the invention generally relates to metallic end closures and containers, the invention and features described herein could easily be implemented on various types of plastic containers and plastic end closures. Additionally, the present invention is generally shown and described with a metallic beverage container end closure; however, the present invention may be employed with an end closure of any size, shape, material, and geometry.

It is thus one aspect of various embodiments of the present invention to provide an inexpensive metallic end closure with improved buckle resistance to avoid buckling near the score line or tear panel and to avoid catastrophic failure, which allows premature opening and spillage.

It is another aspect of various embodiments of the present invention to provide a conventional end closure with buckle control features to isolate where buckling occurs when the container pressure is raised above a predetermined level. One advantage of some embodiments is that the end closure buckling is controlled to certain locations on the end closure, such locations may be away from the score lines and opening.

Another aspect of embodiments of the present invention is to provide a method for manufacturing an end closure with buckle control features. More specifically, a method for forming a beverage can end closure is provided, wherein the container end closure is provided with a buckle coin on the panel of the end closure proximate the pull ring or tab tail (i.e., on the portion of the panel opposite the opening). In some embodiments, the end closure may also have an interrupted panel coin.

It is one aspect of embodiments of the present invention to provide a container end closure with buckle control features that is manufactured using conventional manufacturing equipment. In some embodiments, the buckle coin is formed with well known end closure manufacturing tools and dies including forms, coining (e.g., thinning), or a combination of forms and coining.

In various embodiments, an end closure is provided with a SOT, a buckle coin in the panel, and an interrupted panel coin around the peripheral edge of the panel. In some embodiments, the buckle coin may be disposed generally proximal to the panel edge and in a quadrant of the panel comprising at least a portion of the pull ring or tab tail. In one embodiment, the interrupted panel coin may have only one interruption. In alternative embodiments the interrupted panel coin may have two or more interruptions. In various embodiments, the one or more interruptions may be positioned proximate an induced buckle coin. Note that "peripheral edge" may be used interchangeably herein with "panel edge," "panel radius," and "panel circumference."

In one embodiment of the present invention, a metallic end closure comprises an induced buckle coin and an interrupted panel coin. In another embodiment the end closure comprises an induced buckle coin, an interrupted panel coin, and a continuous panel coin. The continuous panel coin may be an annular band of reduced thickness (referred to in the industry as "coining") along 360° of the shoulder of the central panel to provide additional resistance to buckling, as is known in the art. See, e.g., U.S. Pat. No. 5,590,807 to Forrest; U.S. Pat. Nos. 4,796,772 and 4,577,774 to Nguyen; and U.S. Pat. No. 5,829,623 to Otsuka, all of which are incorporated by reference herein in their entireties.

In one embodiment, a container end closure adapted for interconnection to a container body is provided. The end closure comprises: a peripheral curl, a chuck wall, a countersink having an outer panel wall and an inner panel wall, a central panel, a pull tab, a buckle coin positioned in a quadrant of the end closure without the score, and an interrupted panel coin. Note that the pull tab lift ring is positioned on a tail end of the pull tab, opposite the nose end of the tab. Additionally, in some embodiments, the pull tab may be a promotional tab and not comprise a ring or aperture at all. Rather, the pull tab lift tail may be substantially solid and comprise a promotional saying, name, mascot, shape, or symbol. Thus, the terms "lift ring," "pull ring," "lift tail," and "tail" may be used interchangeably herein. The "pull tab" may also be called the "tab".

In one embodiment, a metallic end closure for a beverage container with buckle control features is provided. The metallic end closure comprises: a peripheral curl which is adapted for interconnection to a neck of a beverage container; a chuck wall extending downwardly from the peripheral curl; a countersink interconnected to a lower end of the chuck wall; an inner panel wall extending upwardly from an interior portion of the countersink; a central panel interconnected to an upper portion of the inner panel wall; a pull tab having a nose end and a tail end which is operably interconnected to the central panel; a first score line in the central panel which defines a tear panel; at least one induced buckle coin positioned proximate to a an outer peripheral edge of the central panel, the induced buckle coin extending around the central panel no greater than about 45 degrees as measured from a center point of the end closure; and a non-continuous panel coin positioned proximate to a panel radius defined by the upper portion of the inner panel wall and the outer peripheral edge of the central panel and interrupted proximate to the at least one induced buckle coin, wherein any buckling of the metallic end closure is initiated proximate to the induced buckle coin when a pressure within the beverage container is elevated above a predetermined level. As appreciated by one skilled in the art, the features of embodiments of the presentment invention could be implemented on any metallic end closure with a variety of geometries and dimensions.

In some embodiments, a metallic end closure for a beverage container with controlled buckling characteristics is provided. The metallic end closure comprises: a peripheral curl which is adapted for interconnection to a neck of a beverage container; a chuck wall extending downwardly from the peripheral curl; a countersink interconnected to a lower end of the chuck wall; an inner panel wall extending upwardly from an interior portion of the countersink; a central panel interconnected to an upper portion of the inner panel wall, the central panel having a substantially planar surface oriented in substantially horizontal plane; a pull tab having a nose end and a tail end, the pull tab is operably interconnected to the central panel; a first score line in the central panel, which defines a substantially hinged tear panel and pour opening; at least one induced buckle coin positioned proximate to a first radius defined by the upper portion of the inner panel wall and an outer peripheral edge of the central panel, the induced buckle coin extending around the first radius no greater than about 90 degrees as measured from a center point of the end closure; and a non-continuous panel coin positioned proximate to the outer peripheral edge of the central panel and interrupted proximate to the at least one induced buckle coin, wherein any buckling of the metallic end closure is initiated proximate to the induced buckle coin when pressure within the beverage container is elevated above a predetermined level. In one embodiment, the inner panel wall further comprises a primary coined region which extends continuously around the first radius.

In various embodiments, a metallic end closure with controlled buckling characteristics is provided. The metallic end closure comprises: a peripheral curl which is adapted for interconnection to a neck of a beverage container; a chuck wall extending downwardly from the peripheral curl; a countersink with a first countersink radius of curvature interconnected to a lower end of said chuck wall; an inner panel wall extending upwardly from an interior portion of said countersink; a central panel with an outer peripheral edge interconnected to an upper portion of the inner panel wall at a panel radius, the central panel having a substantially planar surface oriented in a substantially horizontal plane; a first score line in the central panel, which defines a substantially hinged tear panel and pour opening; at least one induced buckle coin positioned proximate to the outer peripheral edge of the central panel, the at least one induced buckle coin having a width greater than 0.05 inches, and the at least one induced buckle coin extending upwardly from the central panel; and a non-continuous panel coin positioned proximate to the panel radius and interrupted proximate to the at least one induced buckle coin, the non-continuous panel coin having an upper inclined surface positioned at a second angle relative to the substantially horizontal plane of the central panel, wherein any buckling of the metallic end closure is initiated proximate to the induced buckle coin when a pressure within the beverage container is elevated above a predetermined level. In one embodiment, the metallic end closure further comprises an inner panel wall with a continuous panel coin which extends continuously around the panel radius, the continuous panel coin having an upper surface positioned at a first angle relative to the substantially horizontal plane of the central panel, wherein the second angle is greater than the first angle.

Various methods of forming an end closure with a buckle coin and/or an interrupted panel coin are provided. In one embodiment, a method is provided comprising the steps of: providing a blank end panel, forming a rivet at a substantially central location on the end panel, coining the end panel, providing one or more scores for an opening area, providing a debossed panel, providing a buckle coin, providing an interrupted panel coin, and securing a pull tab.

Devices and various methods of the present invention contemplate forming a buckle coin and a panel coin on an end panel (i.e., central panel of an end closure) at various stages of panel formation. For example, a buckle coin and an interrupted panel coin may be formed on an end panel before, during, or after formation of features such as debossed features, rivets, frangible score lines defining opening areas, etc. In one embodiment, a forming tool is provided to form a buckle coin and an interrupted panel coin, while recessed portions of the tool accommodate various preformed features of the panel.

In some embodiments, a method of manufacturing an end closure with controlled buckling characteristics is provided. The method comprises: providing an end closure comprising: a countersink; an inner panel wall extending upwardly from an interior portion of the countersink; a central panel interconnected to an upper portion of the inner panel wall, the central panel having a substantially planar surface oriented in substantially horizontal plane; a pull tab having a nose end and a tail end, the pull tab is operably interconnected to the central panel; and a first score line in the central panel, which defines a substantially hinged tear panel; forming at least one induced buckle coin in the central panel, the at least one induced buckle coin positioned proximate to a panel radius defined by the upper portion of the inner panel wall and an outer peripheral edge of the central panel; and forming a non-continuous panel coin proximate to the panel radius, the non-continuous panel coin interrupted proximate to the at least one induced buckle coin, wherein any buckling of the metallic end closure is initiated proximate to the induced buckle coin when pressure within the beverage container is elevated above a predetermined level. In one embodiment, the method further comprises forming a continuous panel coin which extends continuously around the first radius.

"Coins" and "coining" refer to a metalworking process well known in the art. Coining may involve shaping metal by squeezing the metal between two dies to create thinning. The sheet metal may have different shapes or designs on each side, thus creating differences in the thickness of the metal. Coining may be used to harden and/or shape the metal.

The phrases "at least one," "one or more," and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below.

BRIEF DESCRIPTION OF THE DRAWINGS

Those of skill in the art will recognize that the following description is merely illustrative of the principles of the present invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1:
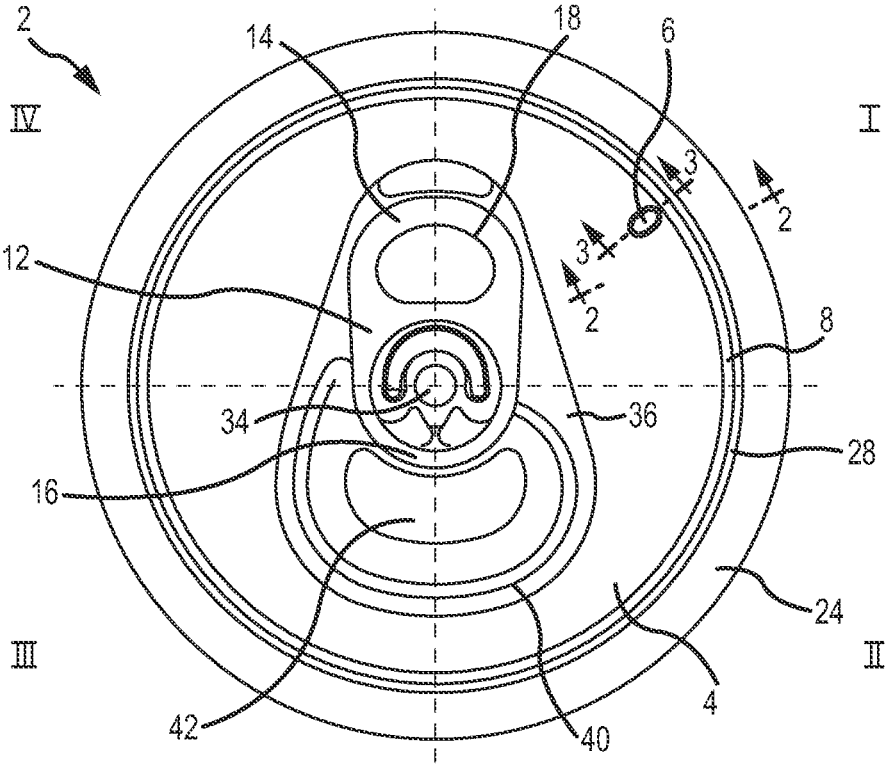
FIG. 1 is a top plan view of an embodiment of an end closure with an induced buckle coin.

To assist in the understanding of the embodiments of the present invention the following list of components and associated numbering found in the drawings is provided herein:

| No. | Component |
|---|---|
| 2 | End Closure |
| 4 | Central Panel |
| 6 | Induced Buckle Coin |
| 8 | Panel Radius |
| 10 | Interrupted Panel Coin |
| 11 | Continuous Panel Coin (360°) |
| 12 | Tab |
| 14 | Tab Tail |
| 16 | Tab Nose |
| 18 | Lift Ring |
| 24 | Peripheral Curl |
| 26 | Chuck Wall |
| 28 | Countersink |
| 30 | Countersink Outer Panel Wall |
| 32 | Countersink Inner Panel Wall |
| 34 | Rivet (may be a centerline rivet) |

-continued

| No. | Component |
|---|---|
| 36 | Deboss Area |
| 40 | Score Line |
| 42 | Pour Opening |
| R1 | Radius of Curvature of Countersink |
| R8 | Radius of Curvature of Panel Radius |
| W1 | Width of Panel Wall |
| H1 | Height Countersink to Buckle Coin |
| H2 | Height Countersink to Panel |
| A1 | Angle of Continuous Panel Coin |
| A2 | Angle of Interrupted Panel Coin |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Referring now to FIGS. 1-20, a beverage container end closure and methods and devices for forming the same according to various embodiments of the present invention are shown. Note that the end closures shown in the figures are end closures before they are double seamed onto a neck of a container body.

FIG. 1 shows the public side of an end closure 2 after an induced buckle coin 6 has been manufactured in quadrant I (upper right quadrant) of the end closure 2. As shown in FIG. 1, the end closure 2 is divided into four quadrants (I-IV) for the ease of discussion. The end closure 2 may comprise a central panel 4, a panel radius 8, a tab 12, and a countersink 28 interconnected to a chuck wall interconnected to a peripheral curl 24. The tab 12 may comprise a tab nose 16 opposite a tab tail 14 and a lift ring 18. The tab 12 may be interconnected to the central panel 4 using a rivet 34. The central panel 4 may comprise a deboss area 36 and a score line 40 defining a tear panel or pour opening 42.

The induced buckle coin 6 creates an area of weakness in the end closure 2. Accordingly, in one embodiment, the induced buckle coin 6 is positioned on the central panel 4 in a location proximate to the tail 14 of the pull tab 12 and away from the score line 40 such that buckling is induced near the induced buckle coin 6 and away from the tear panel 42. The induced buckle coin 6 may be positioned within quadrant I or quadrant IV or any quadrant not comprising the score line 40.

In some embodiments, the induced buckle coin 6 may have an oval, a circular, a triangular, rectangular, a square, a trapezoidal shape, or a promotional shape such as a football, baseball, bat, etc. Thus, the induced buckle coin 6 may be any geometric shape which can be manufactured into the end closure 2. In one embodiment, the length of the induced buckle coin 6 may be measured from the point on the induced buckle coin 6 farthest away from a center point of the end closure 2 to the point on the induced buckle coin 6 closest to the center point of the end closure 2. In some embodiments, the length of the induced buckle coin 6 may be between approximately 0.094 inches and 0.096 inches. The width of the induced buckle coin 6 may be measured from one substantially linear side of the induced buckle coin 6 to the other substantially linear side (if the induced buckle coin 6 has a substantially linear side). In some embodiments, the width of the induced buckle coin may be between approximately 0.054 inches and 0.056 inches. In other embodiments, the induced buckle coin 6 may be positioned in any position or any direction within a quadrant of the end closure 2, as is shown and described in FIGS. 19 and 20, for example.

Figure 2:
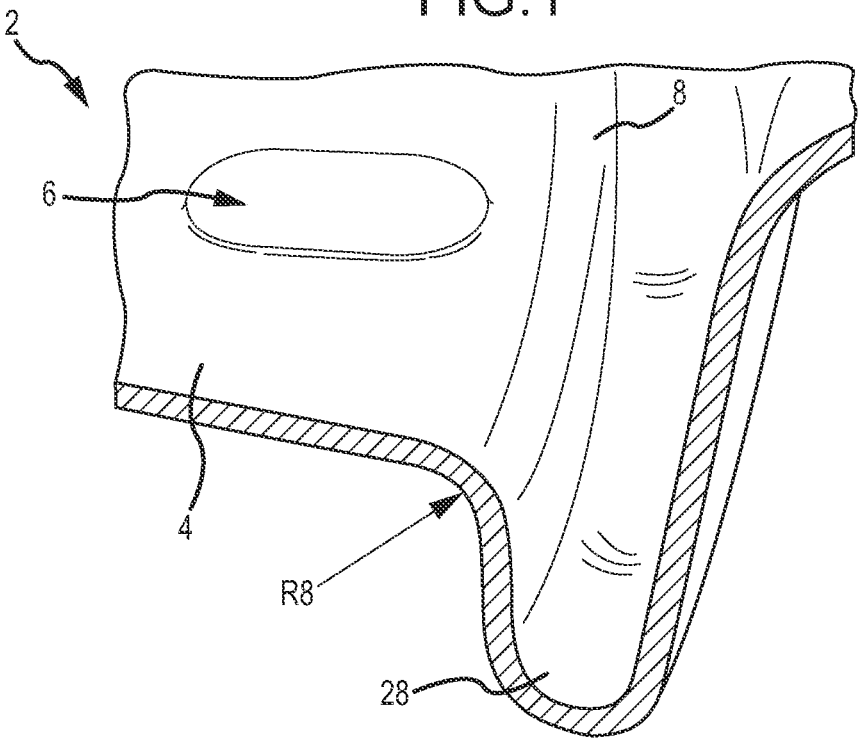
FIG. 2 is a cross-sectional perspective view of the end closure of FIG. 1.

FIG. 2 shows section 2-2 of the end closure 2 of FIG. 1 in a cross sectional perspective view. Specifically, FIG. 2 illustrates an enlarged view of the induced buckle coin 6 on the central panel 4 and the profile of the central panel 4 interconnected at an outer peripheral edge to the countersink 28 at the panel radius 8 having a radius of curvature R8. In one embodiment, the panel radius 8 radius of curvature R8 may range from approximately 0.018" to 0.022". The induced buckle coin 6 is raised above the horizontal plane of the central panel 4. In some embodiments, the induced buckle coin 6 has a flat upper surface, which is parallel to the horizontal plane of the central panel 4.

Figure 3:
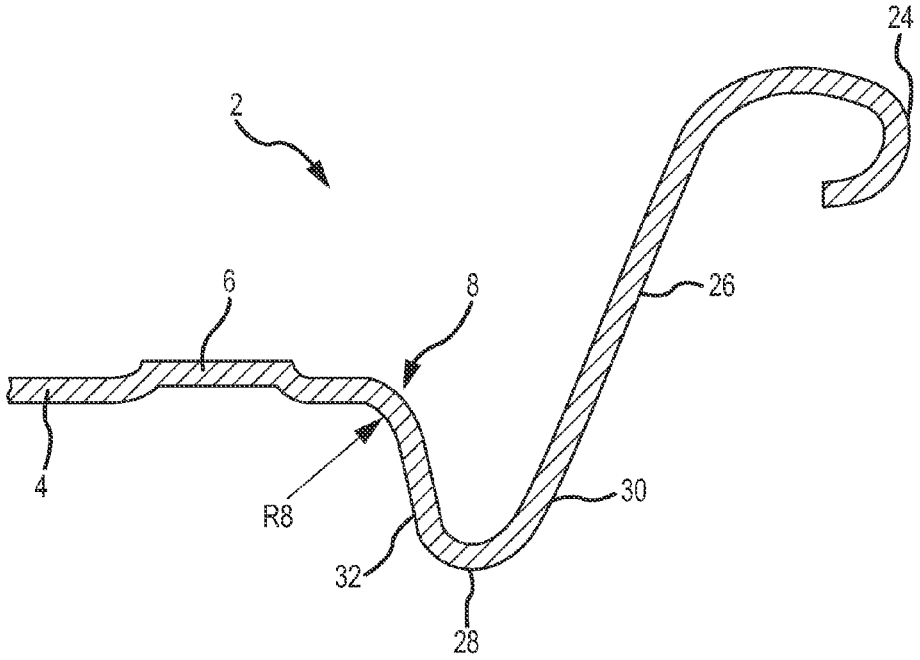
FIG. 3 is a cross-sectional view of the end closure of FIG. 1.

FIG. 3 shows section 3-3 of the end closure of FIG. 1. As is shown in FIG. 1, section 3-3 is cut approximately through the centerline of the induced buckle coin 6. Thus, FIG. 3 shows the profile of the central panel 4 with the induced buckle coin 6, the panel radius 8, the countersink 28, the chuck wall 26, and the peripheral curl 24. The countersink 28 may comprise a countersink outer panel wall 30 interconnected to the chuck wall 26 and a countersink inner panel wall 32 interconnected to the outer peripheral edge of the central panel 4 by the panel radius 8. The panel radius 8 has a radius of curvature R8. FIG. 3, like FIG. 1, shows the end closure 2 after an induced buckle coin 6 has been coined into the central panel 4, and before, during, or after an interrupted panel coin or a continuous panel coin is manufactured into the end closure.

Figure 4:
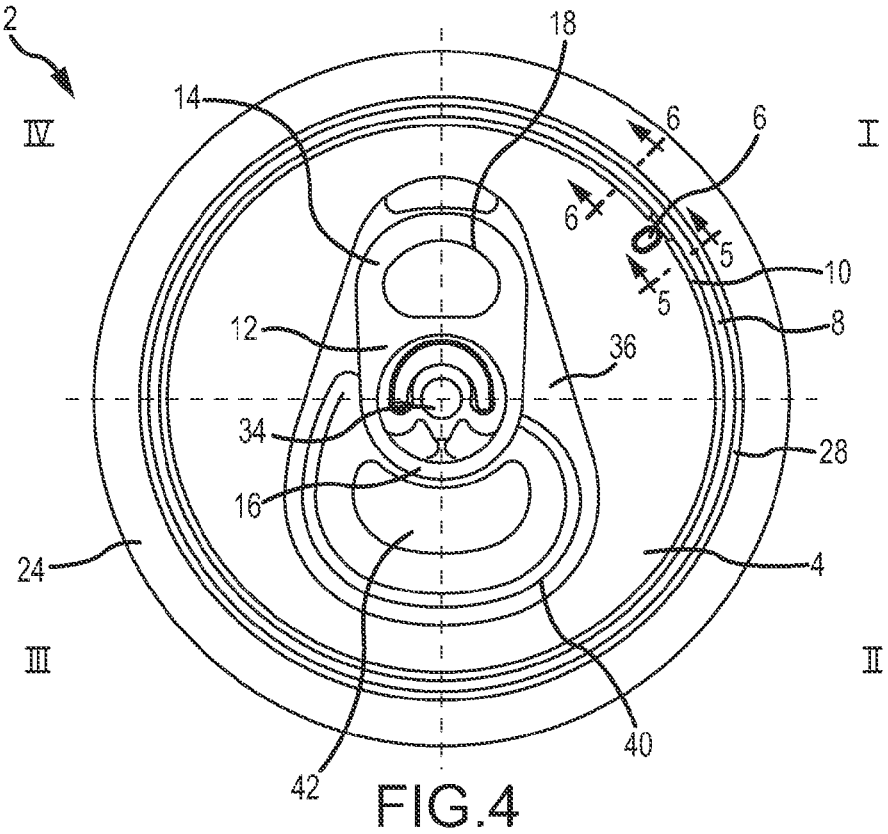
FIG. 4 is a top plan view of an embodiment of an end closure with induced buckle features.

FIG. 4 illustrates the public side of a second embodiment of an end closure 2 with controlled buckling characteristics. The end closure 2 may comprise a central panel 4, a panel radius 8, a tab 12, and a countersink 28 interconnected to a chuck wall interconnected to a peripheral curl 24. The tab 12 may comprise a tab nose 16 opposite a tab tail 14 and a lift ring 18. The tab 12 may be interconnected to the central panel 4 using a rivet 34. The central panel 4 may comprise an induced buckle coin 6, a deboss area 36, and a score line 40 defining a tear panel or pour opening 42.

More specifically, FIG. 4 shows the end closure 2 of FIG. 1 after an interrupted panel coin 10 has been manufactured into the panel radius 8 of the end closure 2. The interrupted panel coin 10 may also be called a "non-continuous panel coin" herein. The interrupted panel coin 10 may or may not actually be coined. The interrupted panel coin 10 is positioned proximate to the peripheral edge of the central panel 4 and is less than 360 degrees around the central panel 4. Thus, in one embodiment, the interrupted panel coin 10 may extend around the central panel 4 approximately 300° or more, but less than 360°. In some embodiments, the interrupted panel coin 10 may be positioned on the panel radius 8 of the end closure 2, where the panel radius 8 is defined by an upper portion of the inner panel wall 32 and the peripheral edge of the central panel 4. The panel radius 8 may also be called a "first radius" or a "shoulder" herein.

The end closure 2 comprises only one induced buckle coin 6 in one of four distinct quadrants I-IV having substantially equal areas. In some embodiments, the one distinct quadrant (e.g., quadrant I or IV) is substantially devoid of the score line 40. In one embodiment, the interruption in the interrupted panel coin 10 is positioned proximate to the induced buckle coin 6. Like the induced buckle coin 6, the interruption in the interrupted panel coin 10 creates an area of weakness. Accordingly, when the pressure within the container comprising the end closure 2 reaches a pressure above a predetermined level, any buckling of the end closure 2 may be initiated near the induced buckle coin 6 and away from the score line 40. In certain embodiments, the width of the interruption in the interrupted panel coin 10 (i.e., the portion of the panel radius 8 not coined) may correlate with the width or length of the induced buckle coin 6. Additionally, the width of the interruption may be measured in inches (or another unit of length/distance) or degrees around the central panel 4. Thus, in one embodiment, the induced buckle coin 6 is approximately 0.054-0.056 inches wide and the interruption in the interrupted panel coin 10 is approximately 0.150-0.152 inches.

Figure 5:
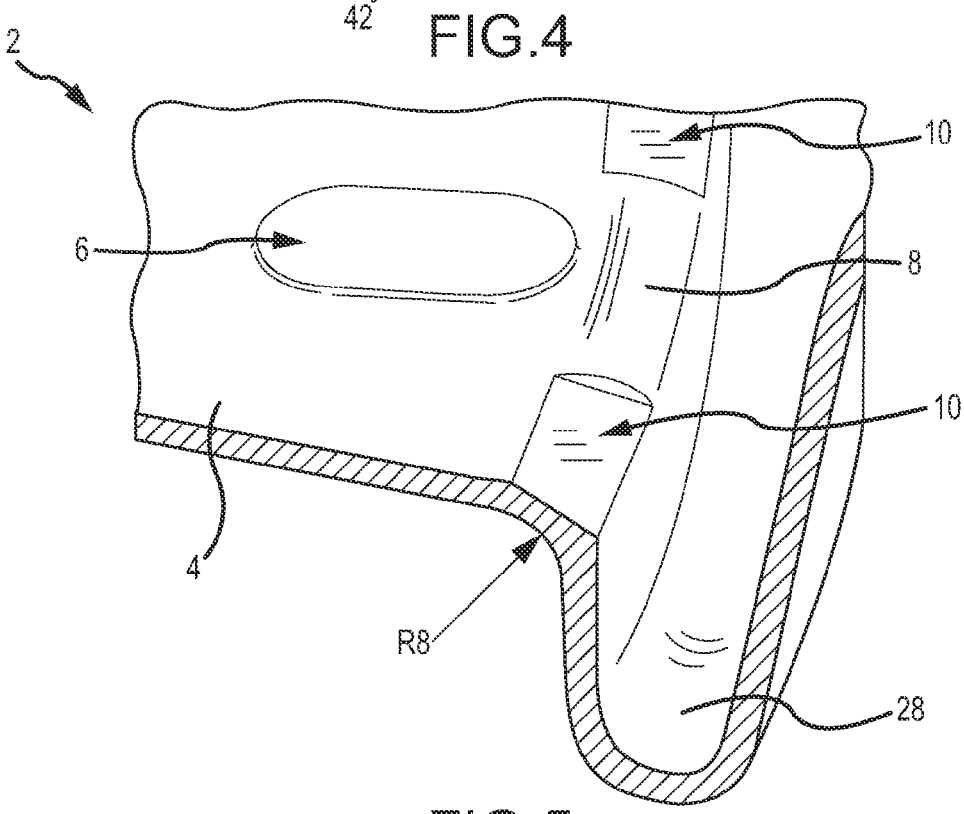
FIG. 5 is a cross-sectional perspective view of the end closure of FIG. 4.

FIG. 5 shows section 5-5 of the end closure 2 of FIG. 4 in a cross sectional perspective view. The end closure 2 has an interrupted panel coin 10 manufactured into the panel radius 8 of the end closure 2. The central panel 4 is interconnected to the inner panel wall of the countersink 28 through a radius of curvature R8. As can be seen in FIG. 5, the interrupted panel coin 10 has a substantially flat upper surface. In some embodiments, the non-continuous panel coin 10 may be coined and thus have a substantially flat upper surface and a rounded lower surface. In other embodiments, the non-continuous panel coin 10 may have a substantially linear cross-sectional shape.

In one embodiment, the interrupted panel coin 10 has one interruption (i.e., the area of the central panel 4 or the panel radius 8 not comprising the interrupted panel coin 10) located proximate to the induced buckle coin 6. Thus, both the interruption in the interrupted panel coin 10 and the induced buckle coin 6 are positioned in only one of four distinct quadrants (I-IV) having substantially equal areas. In other embodiments, the interrupted panel coin 10 may have more than one interruption.

Figure 6:
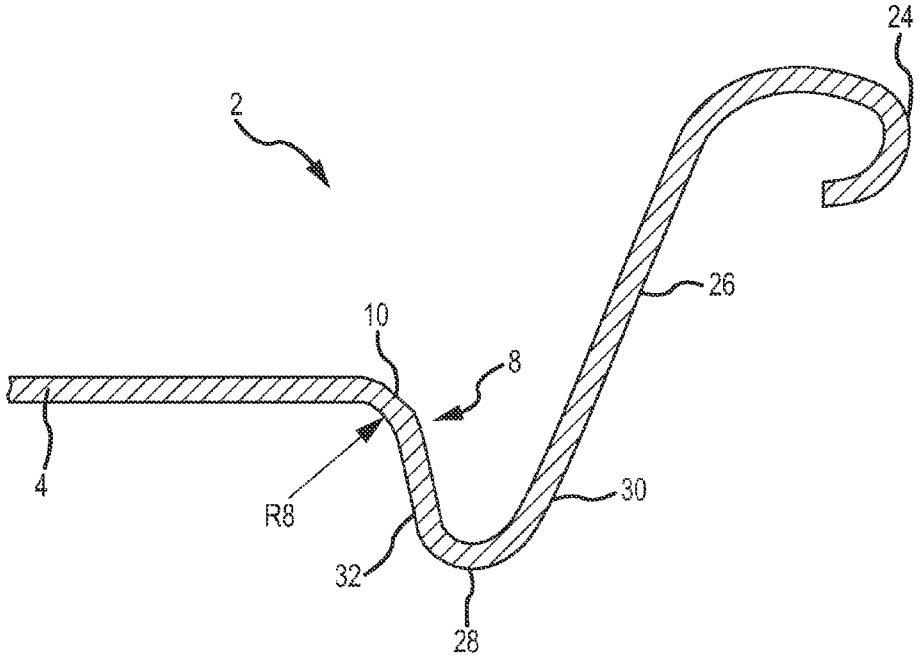
FIG. 6 is a cross-sectional view of the end closure of FIG. 4.

FIG. 6 is section 6-6 of the end closure 2 of FIG. 4. As is shown in FIG. 4, section 6-6 is cut through a section of the end closure 2 with the interrupted panel coin 10 and without the induced buckle coin 6. Thus, FIG. 6 shows the cross-section of the central panel 4 with the interrupted panel coin 10, the panel radius 8, the countersink 28, the chuck wall 26, and the peripheral curl 24. The countersink 28 comprises a countersink outer panel wall 30 interconnected to the chuck wall 26 and a countersink inner panel wall 32 interconnected to the outer peripheral edge of the central panel 4 by the panel radius 8. The panel radius 8 has a radius of curvature R8, which may range from approximately 0.018" to 0.022". FIG. 6, like FIG. 4, shows the end closure 2 after the interrupted panel coin 10 has been manufactured into the end closure.

Figure 7:
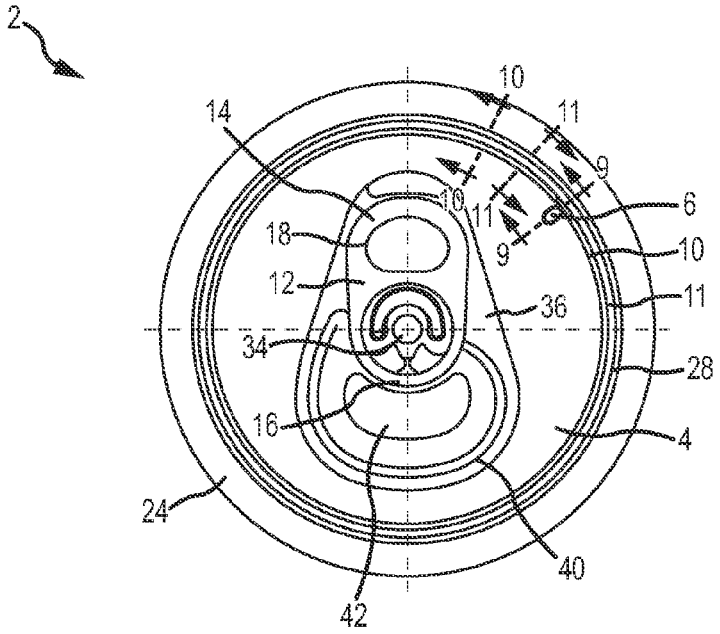
FIG. 7 is a top plan view of an embodiment of an end closure with induced buckle features.

FIG. 7 shows the public side of a third embodiment of an end closure 2. The end closure 2 may comprise a central panel 4, a tab 12, and a countersink 28 interconnected to a chuck wall interconnected to a peripheral curl 24. The tab 12 may comprise a tab nose 16 opposite a tab tail 14 and a lift ring 18. The tab 12 may be interconnected to the central panel 4 using a rivet 34. The central panel 4 may comprise an induced buckle coin 6, a deboss area 36, and a score line 40 defining a tear panel or pour opening 42.

More specifically, FIG. 7 shows the end closure 2 after a continuous panel coin 11 that extends 360° around the central panel 4 has been manufactured into the panel radius, which is positioned between the central panel 4 and the countersink 28 inner panel wall 32. The end closure 2 of FIG. 7 has a continuous panel coin 11, whereas the end closure of FIG. 4 has a rounded panel radius 8. The continuous panel coin 11 is a primary coined region which extends continuously around the outer peripheral edge of the central panel 4. The continuous panel coin 11 is a 360° flattened shoulder that has been strain hardened through a thinning process to increase the buckle resistance of the container through increased rigidity.

FIG. 7 also shows the end closure 2 after induced buckling features (e.g., induced buckle coin 6 and an interrupted panel coin 10) have been manufactured into the end closure 2. In some embodiments, the interrupted panel coin 10 may be positioned proximate to the central panel 4 and the continuous panel coin 11. In one embodiment, the interrupted panel coin 10 may be positioned on the peripheral edge of the central panel 4.

The end closure 2 shown in FIG. 7 comprises only one induced buckle coin 6 in one of four distinct quadrants I-IV having substantially equal areas. In some embodiments, the one distinct quadrant (e.g., quadrant I or IV) is substantially devoid of the score line 40. The interruption in the interrupted panel coin 10 is positioned proximate to the induced buckle coin 6. Thus, both the interruption in the interrupted panel coin 10 and the induced buckle coin 6 are positioned in only one of four distinct quadrants (e.g., quadrant I). In other embodiments, the interrupted panel coin 10 may have more than one interruption. Like the induced buckle coin 6, the interruption in the interrupted panel coin 10 creates an area of weakness. Accordingly, when the pressure within the container comprising the end closure 2 reaches a pressure above a predetermined level, any buckling of the end closure 2 may be initiated near the induced buckle coin 6 and the interruption in the interrupted panel coin 10.

Figure 8:
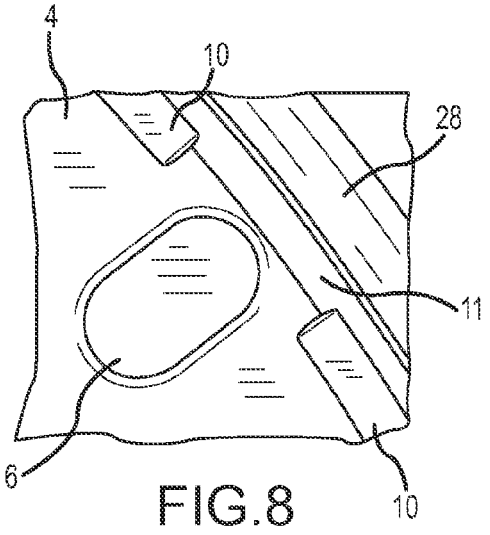
FIG. 8 is an enlarged top plan view of the induced buckle coin of FIG. 7.

FIG. 8 shows an enlarged view of the public side of the induced buckle coin 6 on the central panel 4. In some embodiments, the induced buckle coin 6 may have an oval, a circular, a triangular, a rectangular, a square, or a trapezoidal shape. However, the induced buckle coin 6 may be any shape easily manufactured into the end closure 2, including a promotional shape depicting a football, baseball, mascot, letter, etc. The induced buckle coin 6 may be positioned on the central panel 4 proximate to the peripheral edge of the central panel 4 and the continuous panel coin 11. The interrupted panel coin 10 may have one interruption positioned proximate to the induced buckle coin 6.

Figure 9:
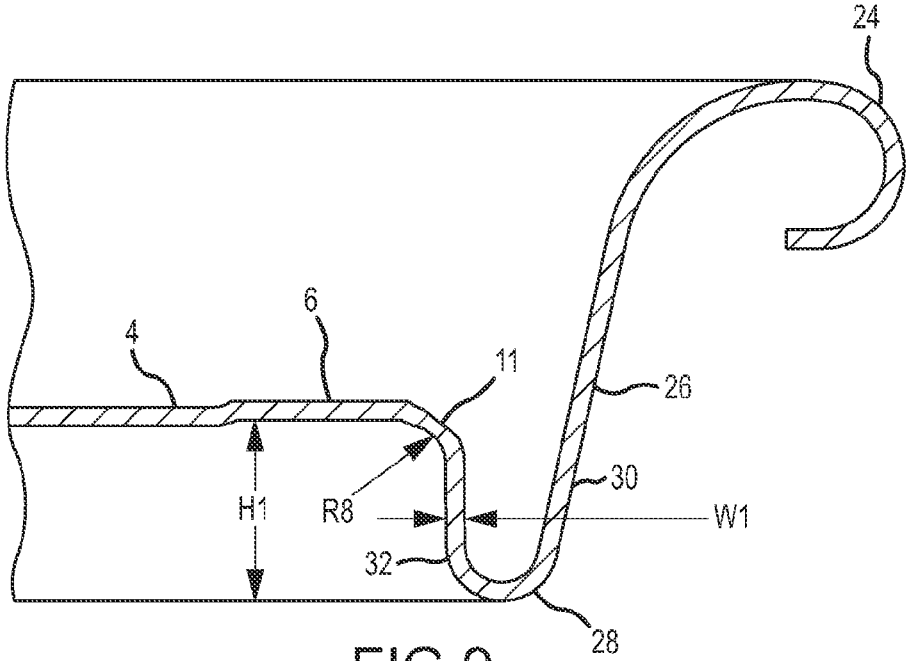
FIG. 9 is a cross-sectional view of the end closure of FIG. 7.

FIG. 9 shows section 9-9 of the end closure 2 of FIG. 7. As is shown in FIG. 7, section 9-9 is cut approximately through the centerline of the induced buckle coin 6, through the interruption in the interrupted panel coin 10, and through the continuous panel coin 11. Thus, FIG. 9 shows the cross-section of the central panel 4, the induced buckle coin 6, the continuous panel coin 11, the countersink 28, the chuck wall 26, and the peripheral curl 24. The countersink 28 comprises a countersink outer panel wall 30 interconnected to the chuck wall 26 and a countersink inner panel wall 32 interconnected to the central panel 4 by the continuous panel coin 11 on the public side and a radius of curvature R8 on the product side. The induced buckle coin 6 is raised above the central panel 4 such that the product side of the induced buckle coin 6 is positioned above the lowermost portion of the countersink 28 a height H1. In one embodiment, the height H1 is approximately 0.003" to 0.005" greater than the height H2 (shown in FIG. 10). Thus, height H1 may range from approximately 0.088 inches to 0.096 inches. The end closure 2 has a thickness of approximately W1. In one embodiment, W1 may range from about 0.0100 inches to 0.0104 inches.

Figure 10:
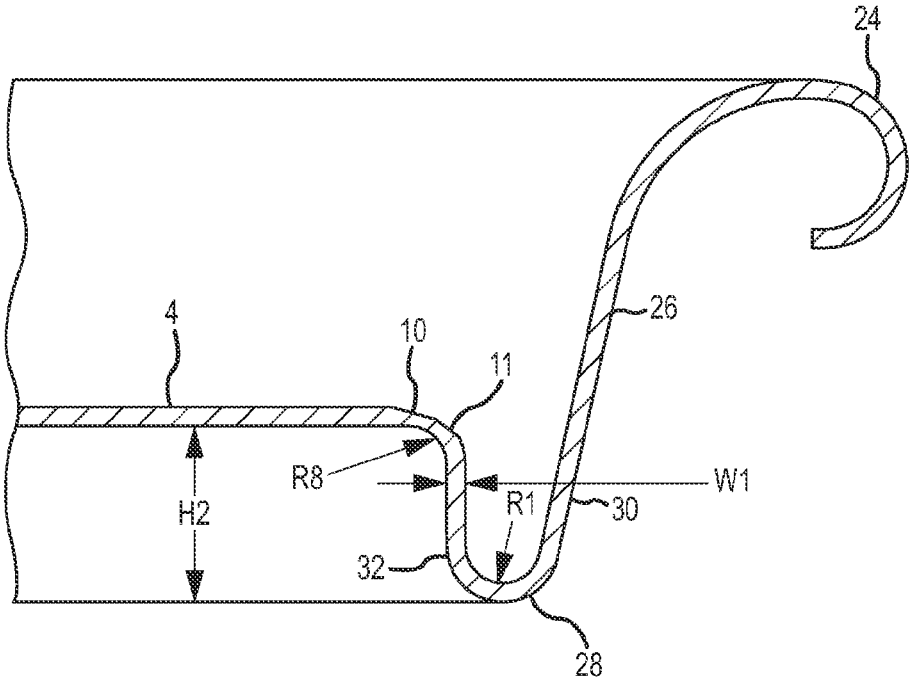
FIG. 10 is a cross-sectional view of the end closure of FIG. 7.

FIG. 10 shows section 10-10 of the end closure 2 of FIG. 7. As is shown in FIG. 7, section 10-10 is cut through the interrupted panel coin 10 and the continuous panel coin 11. Thus, FIG. 10 shows the cross-section of the central panel 4 with the interrupted panel coin 10, the continuous panel coin 11, the countersink 28, the chuck wall 26, and the peripheral curl 24. The angle of the interrupted panel coin 10 relative to the horizontal plane of the end closure 2 may be between about 5° and 45°. In one embodiment, the angle of the interrupted panel coin 10 relative to the horizontal plane of the end closure 2 may be approximately 15°. The angle of the continuous panel coin 11 relative to the horizontal plane of the end closure 2 may be between about 10° and 65°. In one embodiment, the angle of the continuous panel coin 11 relative to the horizontal plane of the end closure 2 may be approximately 38°. The product side of the central panel 4 is positioned above the lowermost portion of the countersink 28 a height H2. In one embodiment, the height H2 is approximately 0.085" to 0.091". The countersink 28 has a radius of curvature R1 and comprises a countersink outer panel wall 30 interconnected to the chuck wall 26 and a countersink inner panel wall 32 interconnected to the central panel 4 by the continuous panel coin 11 on the public side and a radius of curvature R8 on the product side. The countersink 28 radius of curvature R1 may range from approximately 0.018" to 0.022" in one embodiment. The radius of curvature R8 may be between approximately 0.018" and 0.022" in one embodiment. The end closure 2 has a thickness of approximately W1, which may range from about 0.0100 inches to 0.0104 inches.

Figure 11:
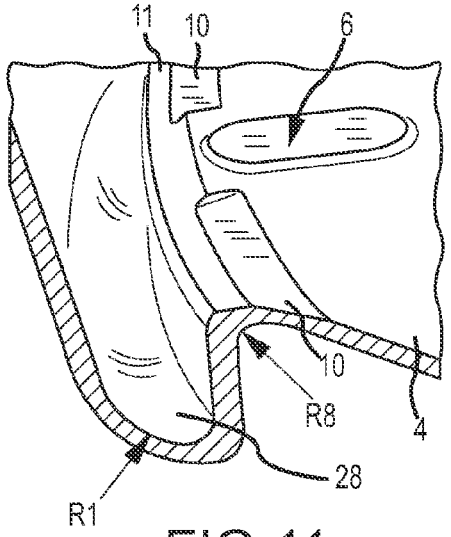
FIG. 11 is a cross-sectional perspective view of the end closure of FIG. 7.

FIG. 11 shows section 11-11 of the end closure 2 of FIG. 7 in a cross sectional perspective view. The induced buckle coin 6 is raised above the horizontal plane of the central panel 4. In some embodiments, the induced buckle coin 6 has a flat upper surface, which is parallel to the horizontal plane of the central panel 4.

In some embodiments, the product side of the central panel 4 is interconnected to the inner panel wall of the countersink 28 through a radius of curvature R8. As can be seen in FIG. 11, the interrupted panel coin 10 has a substantially flat upper surface. The non-continuous panel coin 10 may be coined and thus have a substantially flat upper surface and a rounded lower surface. In other embodiments, the non-continuous panel coin 10 may have a substantially linear cross-sectional shape. Additionally, the continuous panel coin 11 is coined and thus has a substantially flat upper surface and a rounded lower surface. In other embodiments, the continuous panel coin 11 may have a substantially linear cross-sectional shape.

Figure 12:
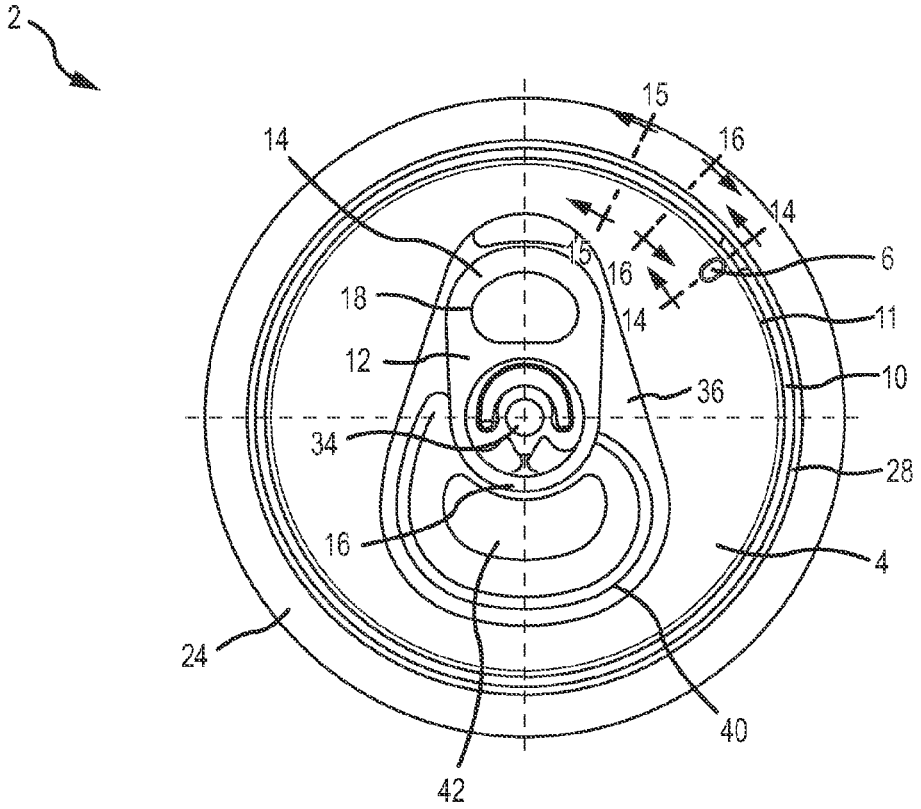
FIG. 12 is a top plan view of an embodiment of an end closure with induced buckle features.

FIG. 12 shows the public side of a fourth embodiment of an end closure 2. The end closure 2 generally comprises a central panel 4, a pull tab 12, and a countersink 28 interconnected to a chuck wall interconnected to a peripheral curl 24. The pull tab 12 may comprise a tab nose 16 opposite a tab tail 14 and a lift ring 18. The tab 12 is typically interconnected to the central panel 4 using a rivet 34. The central panel 4 may comprise an induced buckle coin 6, a deboss area 36, and a score line 40 defining a tear panel or pour opening 42.

FIG. 12 additionally depicts the end closure 2 with a continuous panel coin 11 that extends 360° around the central panel 4 that has been manufactured proximate to the peripheral edge of the central panel 4. The end closure 2 of FIG. 12 has a continuous panel coin 11, and a rounded panel radius (not labeled in FIG. 12). The continuous panel coin 11 is a primary coined region which extends continuously around the entire outer peripheral edge of the central panel 4. The continuous panel coin 11 is a 360° flattened shoulder that has been strain hardened through a thinning or coining process to increase the buckle resistance of the container through increased rigidity.

FIG. 12 additionally shows the end closure 2 with induced buckling features (e.g., induced buckle coin 6 and an interrupted panel coin 10). In some embodiments, the interrupted panel coin 10 may be positioned proximate to the central panel 4 and the continuous panel coin 11. In one embodiment, the interrupted panel coin 10 may be positioned on the peripheral edge of the central panel 4. In another embodiment, the interrupted panel coin 10 may be positioned on the panel radius (not labeled in FIG. 12).

Figure 17:
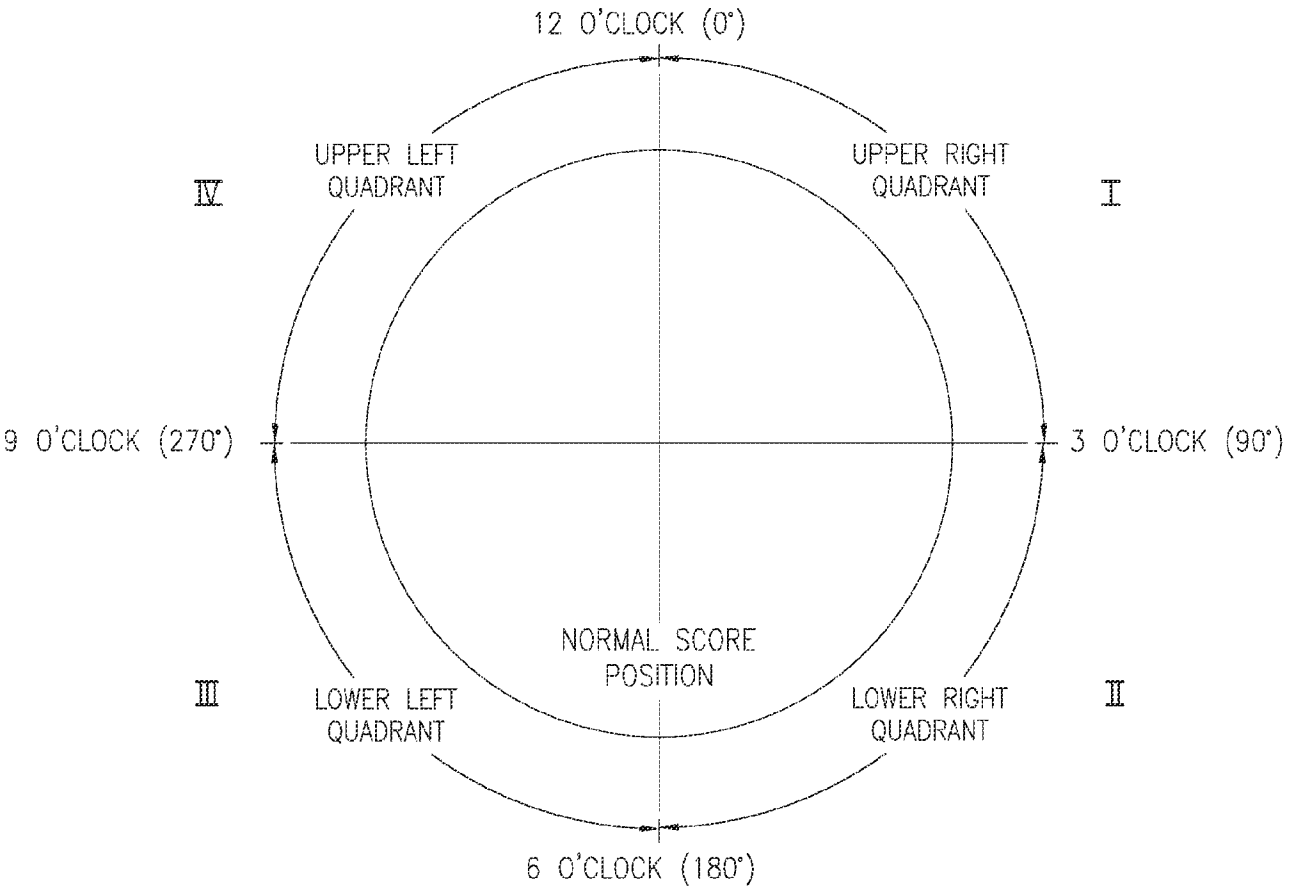
FIG. 17 shows quadrant zones and clock references consistent with embodiments of the present invention.

The end closure 2 shown in FIG. 12 comprises only one induced buckle coin 6 in one of four distinct quadrants I-IV having substantially equal areas, as shown in FIG. 17. In some embodiments, the one distinct quadrant (e.g., quadrant I or IV) is substantially devoid of the score line 40. The interruption in the interrupted panel coin 10 is positioned proximate to the induced buckle coin 6. Thus, both the interruption in the interrupted panel coin 10 and the induced buckle coin 6 are generally positioned in only one of four distinct quadrants (e.g., quadrant I), and more typically in quadrant I or IV, which does not include a score line for the pour opening. In other embodiments, the interrupted panel coin 10 may have more than one interruption. Like the induced buckle coin 6, the interruption in the interrupted panel coin 10 creates an area of weakness. Accordingly, when the pressure within the container reaches a predetermined level, any buckling of the end closure 2 may be initiated near the induced buckle coin 6 and the interruption in the interrupted panel coin 10, to prevent the score line from failing and creating a "peak and leak" occurrence.

Figure 13:
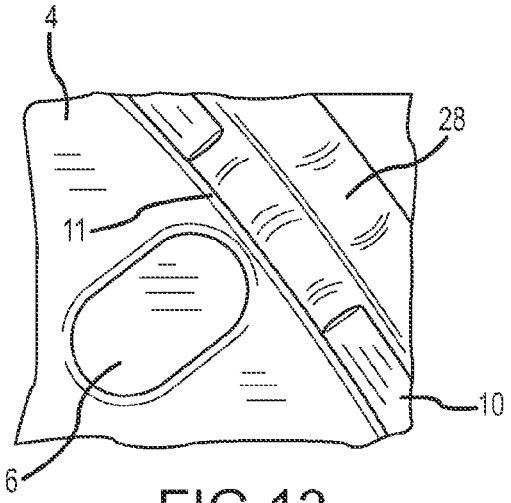
FIG. 13 is an enlarged top plan view of the induced buckle coin of FIG. 12.

FIG. 13 depicts an enlarged view of the public side of the induced buckle coin 6 on the central panel 4. In some embodiments, the induced buckle coin 6 may have an oval, a circular, a rectangular, a triangular, a square, or a trapezoidal shape. However, the induced buckle coin 6 may be any shape easily manufactured into the end closure 2, such as a promotional shape as shows in FIG. 20. The induced buckle coin 6 may be positioned on the central panel 4 proximate to the peripheral edge of the central panel 4 and the continuous panel coin 11. The interrupted panel coin 10 may have one interruption positioned proximate to the induced buckle coin 6.

Figure 14:
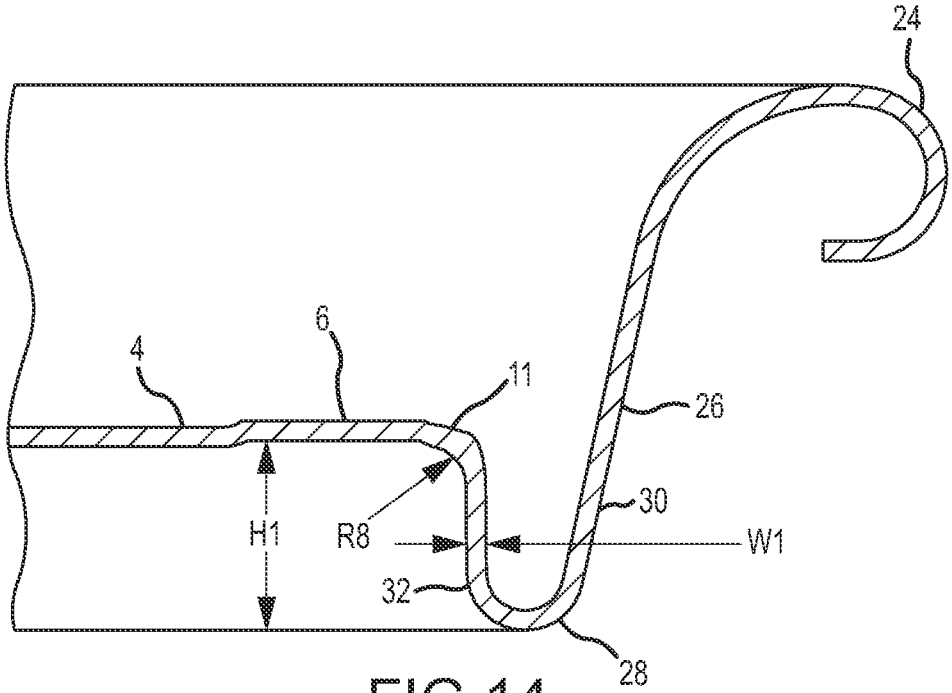
FIG. 14 is a cross-sectional view of the end closure of FIG. 12.

FIG. 14 shows a cross-sectional elevation view at line 14-14 of the end closure 2 shown in FIG. 12. As provided in FIG. 12, section 14-14 is cut approximately through the centerline of the induced buckle coin 6, through the interruption in the interrupted panel coin 10, and through the continuous panel coin 11. Thus, FIG. 14 shows the cross-section of the central panel 4, the induced buckle coin 6, the continuous panel coin 11, the panel radius, the countersink 28, the chuck wall 26, and the peripheral curl 24. The countersink 28 comprises a countersink outer panel wall 30 interconnected to the chuck wall 26 and a countersink inner panel wall 32 interconnected to the central panel 4 by the continuous panel coin 11 and the panel radius on the public side and a radius of curvature R8 on the product side. The induced buckle coin 6 is raised above the central panel 4 such that the product side of the induced buckle coin 6 is positioned above the lowermost portion of the countersink 28 a height H1. In one embodiment, the induced buckle coin 6 is raised approximately 0.003" to 0.005" above the central panel 4. Thus, the height H1 is approximately 0.003" to 0.005" greater than the height H2 (shown in FIG. 10). Accordingly, the height H1 may range from approximately 0.088 inches to 0.096 inches. The end closure 2 has a thickness of approximately W1. In one embodiment, W1 may range from about 0.0100 inches to 0.0104 inches.

Figure 15:
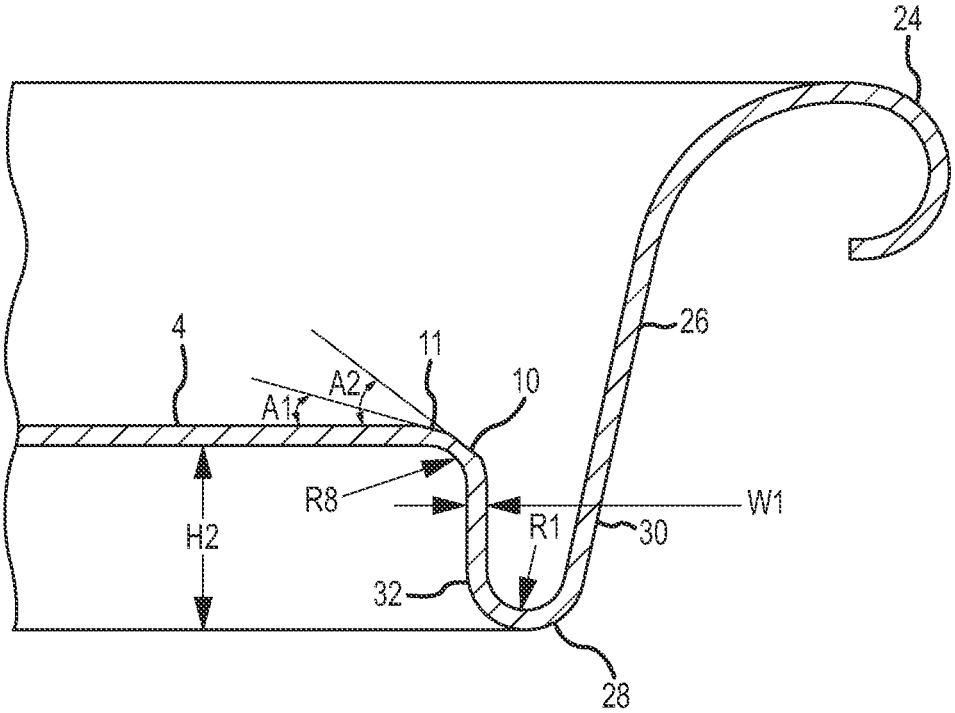
FIG. 15 is a cross-sectional view of the end closure of FIG. 12.

FIG. 15 shows section 15-15 of the end closure 2 provided in FIG. 12. As is shown in FIG. 12, section 15-15 is cut through the interrupted panel coin 10 and the continuous panel coin 11. Thus, FIG. 15 shows the cross-section of the central panel 4 with the interrupted panel coin 10, the continuous panel coin 11, the countersink 28, the chuck wall 26, and the peripheral curl 24. The angle A2 of the interrupted panel coin 10 relative to the horizontal plane of the end closure 2 may be between about 5° and 45°. In one embodiment, the angle A2 is approximately 15°. The angle A1 of the continuous panel coin 11 relative to the horizontal plane of the end closure 2 may be between about 10° and 65°. In one embodiment, the angle A1 is approximately 38°. The product side of the central panel 4 is positioned above the lowermost portion of the countersink 28 a height H2. In one embodiment, the height H2 is approximately 0.085" to 0.091". The countersink 28 has a radius of curvature R1 and comprises a countersink outer panel wall 30 interconnected to the chuck wall 26 and a countersink inner panel wall 32 interconnected to the central panel 4 by the continuous panel coin 11 on the public side and a radius of curvature R8 on the product side. The countersink 28 radius of curvature R1 may range from approximately 0.018" to 0.022" in one embodiment. The radius of curvature R8 may be between approximately 0.018" and 0.022" in one embodiment. The end closure 2 has a thickness of approximately W1, which may range from about 0.0100 inches to 0.0104 inches.

Figure 16:
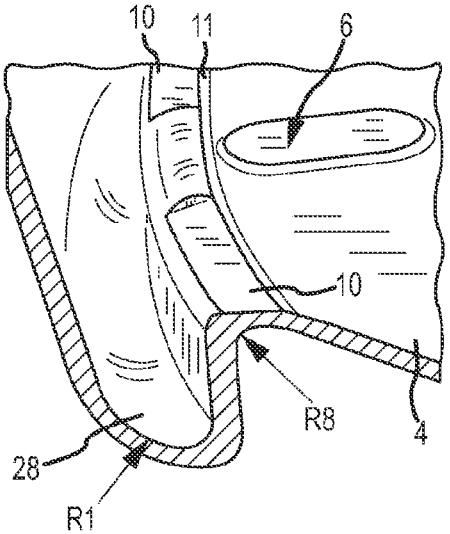
FIG. 16 is a cross-sectional perspective view of the end closure of FIG. 12.

FIG. 16 shows a perspective view of section 16-16 of the end closure 2 in FIG. 12. The induced buckle coin 6 is raised above the horizontal plane of the central panel 4. In some embodiments, the induced buckle coin 6 has a flat upper surface, which is parallel to the horizontal plane of the central panel 4.

In some embodiments, the product side of the central panel 4 is interconnected to the inner panel wall of the countersink 28 through a radius of curvature R8. As depicted in FIG. 16, the interrupted panel coin 10 has a substantially flat upper surface. The non-continuous panel coin 10 may be coined and thus have a substantially flat upper surface and a rounded lower surface. In other embodiments, the non-continuous panel coin 10 may have a substantially linear cross-sectional shape. Additionally, the continuous panel coin 11 has a substantially flat upper surface and a rounded lower surface. In other embodiments, the continuous panel coin 11 may have a substantially linear cross-sectional shape. FIG. 17 shows the quadrant zones and analog clock face references for an end closure consistent with embodiments of the present invention. The 6 o'clock position of the end closure is at the bottom of the end closure when viewing the end closure from above, i.e., the 180° position or south position. The lowermost portion of the score line is typically located at a 6 o'clock position. The 12 o'clock position is opposite the 6 o'clock position, i.e., the 0° position or north position. The tab tail is usually located at the 12 o'clock position. The 3 o'clock position is between the 6 o'clock position and the 12 o'clock position on the right side when viewing the end closure from above, i.e., the 90° position or east position. The 9 o'clock position is between the 6 o'clock position and the 12 o'clock position on the left side when viewing the end closure from above, i.e., the 270° position or west position. FIG. 17 also shows the four quadrants of the end closure: I is the upper right quadrant, II is the lower right quadrant, III is the lower left quadrant, and IV is the upper left quadrant.

Figure 18:
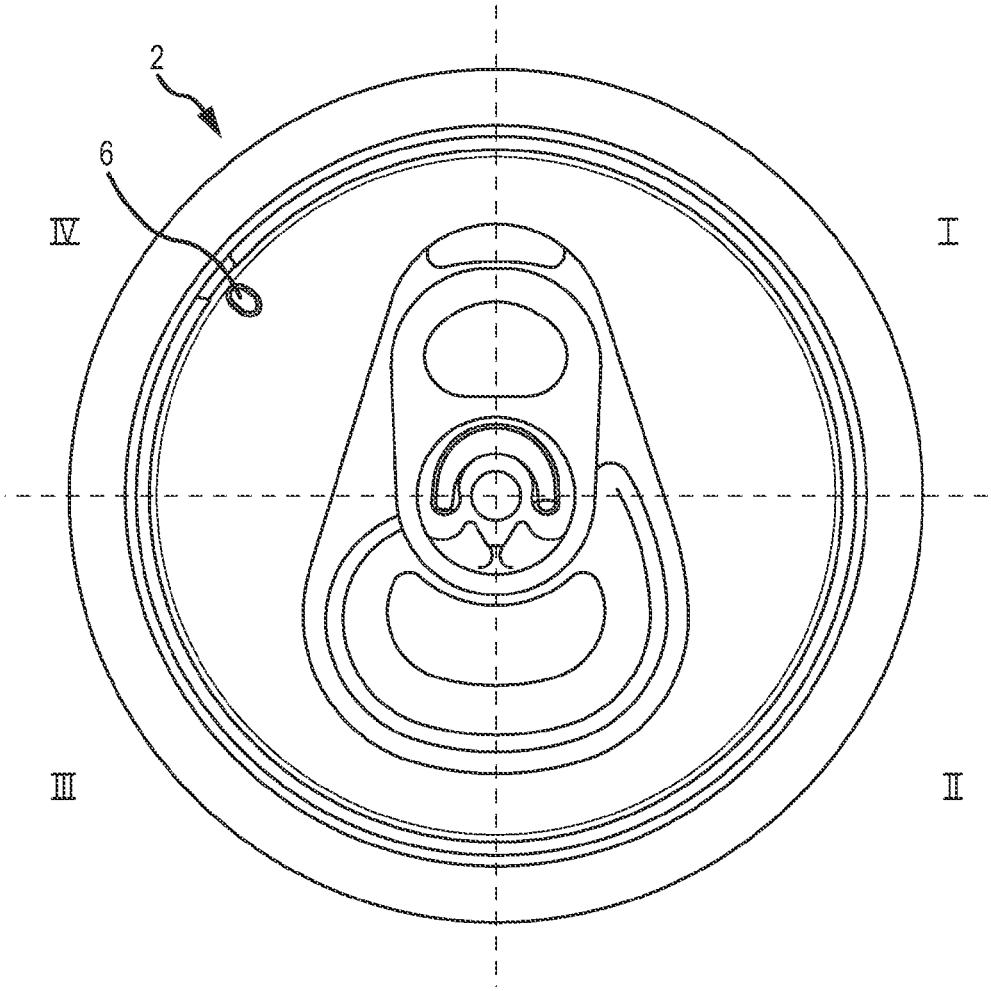
FIG. 18 is a top plan view of an embodiment of an end closure with induced buckle features.

FIG. 18 is the public side of a fourth embodiment of an end closure 2 with an induced buckle coin 6. The end closure 2 of FIG. 18 shows an alternate location for the induced buckle coin 6. The induced buckle coin 6 is located in quadrant IV of the end closure 2. In other embodiment, the induced buckle coin 6 may actually be located anywhere in quadrant I or IV, i.e., closer to the vertical centerline or closer to the horizontal centerline. For example in one embodiment, the induced buckle coin 6 may be anywhere from 0-90° from the vertical centerline, i.e., anywhere in quadrant I or quadrant IV. In another embodiment, the induced buckle coin 6 may be positioned 35-55° from the vertical centerline. Thus, the location of the buckle coin is not limited to the exact locations shown in FIGS. 1-16 and 18-19. For example, the induced buckle coin 6 may be farther away from the peripheral edge of the central panel or the induced buckle coin 6 may be positioned 0° from the vertical center line, 5° from the vertical centerline, 30° from the vertical center line, etc. In some embodiments, the end closure 2 may comprise more than one induced buckle coin 6 in a quadrant, but the end closure 2 will only have induced buckle coins 6 in one quadrant. Furthermore, the induced buckle coin may be larger (i.e., longer and/or wider) than is shown in FIGS. 1-16 and 18-20. In certain embodiments, the induced buckle coin 6 may be positioned anywhere and be any dimension, size, or shape. For example, the induced buckle coin 6 may be in quadrant I and positioned somewhere between 0° (i.e., the 12 o'clock position) and 90° (i.e., the 3 o'clock position). The length and width of the induced buckle coin 6 may be measured in inches or another length measurement unit. In one embodiment, the width of the induced buckle coin may be between approximately 0.054 inches and 0.056 inches. In some embodiments, the length of the induced buckle coin 6 may be between approximately 0.094 inches and 0.096 inches.

Figure 19:
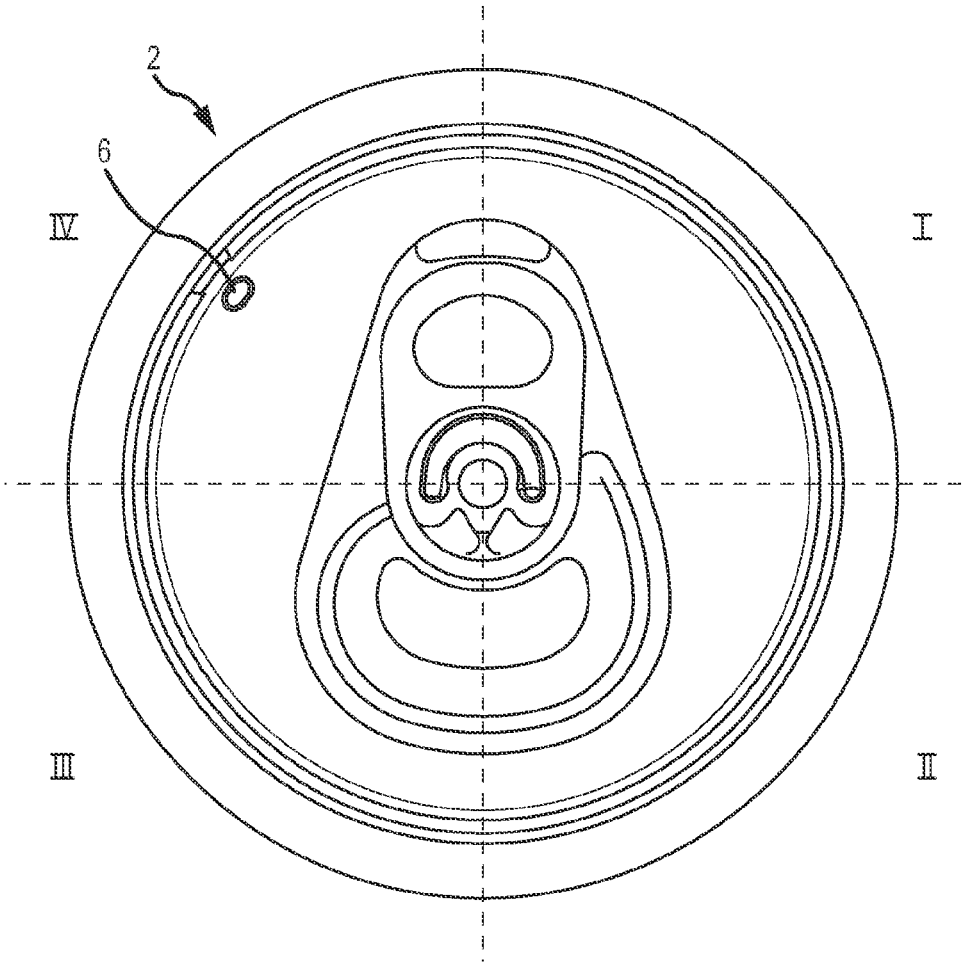
FIG. 19 is a top plan view of an embodiment of an end closure with induced buckle features.

FIG. 19 shows an alternate orientation of the induced buckle coin 6. Thus, the center line of the induced buckle coin 6 may be positioned along a radial of the end closure 2 extending from a center point of the end closure 2 (as is shown in FIGS. 1-16 and 18) or the center line of the induced buckle coin 6 may be positioned perpendicular to a radial of the end closure 2, as is shown in FIG. 19. Alternatively, the center line of the induced buckle coin 6 may be positioned parallel to the vertical center line of the end closure 2 or parallel to the horizontal center line of the end closure 2. In other embodiments, the induced buckle coin 6 may be positioned at any angle relative to the center lines of the end closure 2.

Figure 20:
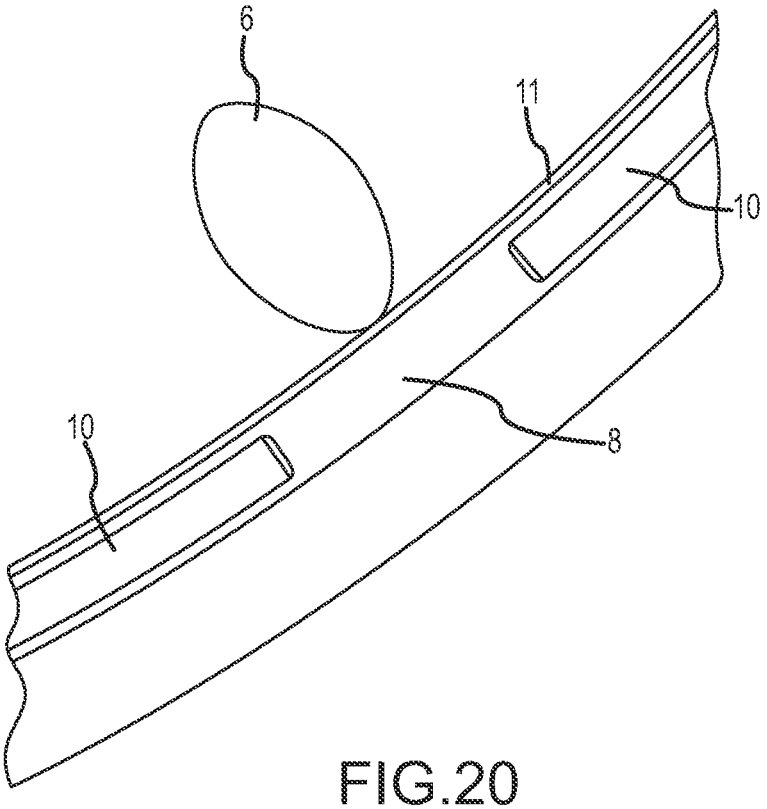
FIG. 20 is an enlarged top plan view of an embodiment of an end closure with induced buckle features.

FIG. 20 shows an alternate embodiment of an end closure with an induced buckle coin 6 with a unique shape. The induced buckle coin 6 of FIG. 20 is shaped like a football. Thus, the induced buckle coin 6 may have any shape, including a promotional shape such as a football, baseball, bat, etc. The end closure may also comprise a continuous panel coin 11, an interrupted panel coin 10, and a panel radius 8.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting.

What is claimed is:

1. A metallic end closure with controlled buckling characteristics, comprising:

a peripheral curl which is adapted for interconnection to a neck of a beverage container;

a chuck wall extending downwardly from said peripheral curl;

a countersink interconnected to a lower end of said chuck wall;

an inner panel wall extending upwardly from an interior portion of said countersink;

a central panel interconnected to an upper portion of said inner panel wall, said central panel having a substantially planar surface oriented in a substantially horizontal plane;

a pull tab having a nose end and a tail end, said pull tab operably interconnected to said central panel;

a first score line in said central panel, which defines a substantially hinged tear panel and pour opening;

at least one induced buckle coin positioned on said central panel and proximate to an outer peripheral edge of said central panel, said induced buckle coin extending around said central panel no greater than about 90 degrees as measured from a center point of said end closure;

a panel radius defined by said upper portion of said inner panel wall and said outer peripheral edge of said central panel, said panel radius having a first radius of curvature, and wherein said panel radius comprises a continuous panel coin which extends continuously around said panel radius; and a non-continuous panel coin positioned proximate to said panel radius and interrupted proximate to said at least one induced buckle coin, wherein a furthermost point of said at least one induced buckle coin from said center point does not extend beyond an innermost edge of said non-continuous panel coin, and wherein any buckling of said metallic end closure is initiated proximate to said at least one induced buckle coin when a pressure within said beverage container is elevated above a predetermined level.

2. The metallic end closure of claim 1, wherein said at least one induced buckle coin is positioned on said central panel in a location proximate to said tail end of said pull tab.

3. The metallic end closure of claim 1, wherein said at least one induced buckle coin is raised above said horizontal plane of said central panel.

4. The metallic end closure of claim 3, wherein said induced buckle coin has at least one of an oval, a circular, a triangular, a football, a baseball, a baseball bat, a rectangular, a square, and a trapezoidal shape.

5. The metallic end closure of claim 1, wherein said non-continuous panel coin has a cross-sectional geometric configuration defined by a substantially flat upper surface and a rounded lower surface.

6. The metallic end closure of claim 1, wherein said continuous panel coin has a substantially flat upper surface.

7. The metallic end closure of claim 1, wherein the metallic end closure comprises only one induced buckle coin in one of four distinct quadrants having substantially equal areas, said one distinct quadrant substantially devoid of said score line.

8. A method of manufacturing an end closure with controlled buckling characteristics comprising:

providing an end closure comprising:

a peripheral curl;

a chuck wall extending downwardly from said peripheral curl;

a countersink interconnected to a lower end of said chuck wall;

an inner panel wall extending upwardly from an interior portion of said countersink;

a central panel interconnected to an upper portion of said inner panel wall, said central panel having a substantially planar surface oriented in substantially horizontal plane;

a pull tab having a nose end and a tail end, said pull tab is operably interconnected to said central panel; and a first score line in said central panel, which defines a substantially hinged tear panel;

forming at least one induced buckle coin in said central panel, said at least one induced buckle coin positioned proximate to a panel radius defined by said upper portion of said inner panel wall and an outer peripheral edge of said central panel;

forming a continuous panel coin which extends continuously around said panel radius; and forming a non-continuous panel coin proximate to said panel radius, said non-continuous panel coin interrupted proximate to said at least one induced buckle coin, wherein a furthermost point of said at least one induced buckle coin from said center point does not extend beyond an innermost edge of said non-continuous panel coin, and wherein any buckling of said metallic end closure is initiated proximate to said at least one induced buckle coin when pressure within said beverage container is elevated above a predetermined level.

9. The method of manufacturing an end closure of claim 8, wherein said at least one induced buckle coin is positioned on said central panel in a location proximate to said tail end of said pull tab.

10. The method of manufacturing an end closure of claim 8, wherein said at least one induced buckle coin is raised above said horizontal plane of said central panel.

11. The method of manufacturing an end closure of claim 10, wherein said induced buckle coin has at least one of an oval, a circular, a triangular, a promotional, a rectangular, a square, and a trapezoidal shape.

12. The method of manufacturing an end closure of claim 8, wherein said non-continuous panel coin has a substantially linear cross-sectional shape.

13. The method of manufacturing an end closure of claim 8, wherein said continuous panel coin has a cross-sectional shape with a substantially flat upper surface and a rounded lower surface.

14. The method of manufacturing an end closure of claim 8, wherein said at least one induced buckle coin is positioned in only one of four distinct quadrants having substantially equal areas.

15. The method of manufacturing an end closure of claim 8, wherein the metallic end closure comprises only one induced buckle coin in one of four distinct quadrants having substantially equal areas, said one distinct quadrant substantially devoid of said score line.

16. A metallic end closure with controlled buckling characteristics, comprising:

a peripheral curl which is adapted for interconnection to a neck of a beverage container;

a chuck wall extending downwardly from said peripheral curl;

a countersink with a first countersink radius of curvature interconnected to a lower end of said chuck wall;

an inner panel wall extending upwardly from an interior portion of said countersink;

a central panel with an outer peripheral edge interconnected to an upper portion of said inner panel wall at a panel radius, said central panel having a substantially planar surface oriented in a substantially horizontal plane;

a first score line in said central panel, which defines a substantially hinged tear panel and pour opening;

at least one induced buckle coin positioned proximate to said outer peripheral edge of said central panel, said at least one induced buckle coin having a width greater than 0.05 inches, and said at least one induced buckle coin extending upwardly from said central panel;

a non-continuous panel coin positioned proximate to said panel radius and interrupted proximate to said at least one induced buckle coin, said non-continuous panel coin having an upper inclined surface positioned at a second angle relative to said substantially horizontal plane of said central panel; and a continuous panel coin region which extends continuously around said panel radius, wherein any buckling of said metallic end closure is initiated proximate to said induced buckle coin when a pressure within said beverage container is elevated above a predetermined level.

17. The metallic end closure of claim 16, wherein said continuous panel coin region has a substantially flat upper surface positioned at a first angle relative to said substantially horizontal plane of said central panel, and wherein said second angle is greater than said first angle.

18. The metallic end closure of claim 1, wherein said continuous panel coin is positioned closer to said at least one induced buckle coin than said non-continuous panel coin.

* * * * *